United States Patent [19]

Rubik

[11] 4,378,117

[45] Mar. 29, 1983

[54] SPATIAL LOGICAL TOY

[75] Inventor: Ernö Rubik, Budapest, Hungary

[73] Assignee: Politoys Ipari Szövetkezet, Budapest, Hungary

[21] Appl. No.: 289,193

[22] Filed: Aug. 3, 1981

[30] Foreign Application Priority Data

Oct. 2, 1980 [HU] Hungary ..... 2406/80

[51] Int. Cl.[3] ..... A63F 9/08

[52] U.S. Cl. ..... 273/153 S

[58] Field of Search ..... 273/153 S, 155

[56] References Cited

FOREIGN PATENT DOCUMENTS

| | | | |
|---|---|---|---|
| 170062 | 12/1977 | Hungary | 273/153 S |
| 55-3956 | 1/1980 | Japan | 273/153 S |
| 55-8193 | 3/1980 | Japan | 273/153 S |

*Primary Examiner*—Anton O. Oechsle
*Attorney, Agent, or Firm*—Gabriel P. Katona

[57] ABSTRACT

A spatial logical toy in form of a regular geometrical solid, the toy-elements of which are assembled so that halves of the logical toy taken along any axis can be rotated in any direction of any of the spatial axes of the body in relation to the other half. The toy comprises a total of eight toy-elements, seven of which are identically shaped and are designed in such a way, that the corners are directed to the geometrical center of the body forming the spatial logical toy and are formed as profiles with a spherical surface. In the assembled state, between the profiles a hollow connecting element with a spherical surface on the upper part and having a T-shaped cross section is arranged. At the bottom of the hollow part of the connecting elements is a bore and a threaded pivot enclosed by a spring reaching to the bottom of the recess is passed through the bore and the threaded end of the pivot is screwed into a part of the eight toy-element which is directed to the geometrical center of the solid. The eighth toy-element is formed with a spherical cam and the spatial axes passing through the corner of the eight toy-element is directed to the inside of the body and through the surface center of the body.

4 Claims, 7 Drawing Figures

SPATIAL LOGICAL TOY

BACKGROUND OF THE INVENTION

The present invention relates to a spatial logical toy comprising a total of eight toy-elements, e.g. eight cubes or eight other solids with a spherical outer surface, which form a large cube, sphere or other geometrical solid in an assembled state.

In a known preferred embodiment, the solid forming the toy is a regular geometrical solid confined by planes, preferably a cube, built up of eight small cubic toy-elements, with any four small cubes forming one surface of the overall larger cube and which may be rotated into any direction of the spatial axes of the toy, along spatial axes within the cube. The small cubic elements forming the plane surfaces of the large cube are either colored or indicated with numbers, figures or any other symbols. Accordingly, by rotating the cubes, several combinations become possible in compliance with the contents yielded by the indicia.

A spatial toy based on the same principle is disclosed in the HU-PS No. 170 062 of the same applicant.

Another well-known solution has been described in the Japanese Patent No. 55.8193 granted in 1977, comprising a total of eight cubes which form one large cube in the assembled state. This logical toy has been designed in such a manner, that one cube out of the eight cubes is fastened to a centrally positioned rotating element. One corner each of the remaining seven cubes is formed with a spherical surface. The rotation is enabled by the plate or slab shaped body following the curvature of the sphere having been fixed to the pivot protruding from the rounded curved corners of the small cubes, while the pivot itself is fixed by a threaded pin to the centrally arranged sphere.

A disadvantage of this design is that it does not ensure an accurate and smooth mutual displacement, since there is a certain clearance and the plate-shaped solids get deformed, thereby limiting the number of rotations.

SUMMARY OF THE INVENTION

The main object of the invention is to improve the spatial logical toy according to HU-PS No. 170 062 and to eliminate the disadvantages of the prior art constructions.

Another object of the spatial logical toy according to the present invention is to create a novel logical toy by simplifying the cubiform or spherical body consisting of $2\times2\times2$ toy-elements, preferably small cubes, so that it is constructed like a logical toy built up in accordance with the construction mode of that comprising $3\times3\times3$ toy-elements. It is to be understood that when speaking about a toy built up of $2\times2\times2$ or $3\times3\times3$ toy elements, it is meant that this is the number of toy-elements to be seen on one of the edges of the spatial logical toy, e.g. on a cube.

The essence of the invention lies in the fact that resilient pivots are built-in, in accordance with the invention, which always induce identical and controllable frictional forces between the spherical surfaces being displaced on each other. The assembled toy-elements are displaced on each other without any clearance and with a continuous joint and as a consequence, for all practical purposes, their useful life is unlimited.

In accordance with the principles of the invention, the spatial logical toy comprising $2\times2\times2$ elements has been developed by means of a construction mode, according to which the large cube or sphere to be assembled from the eight small cubes or eight toy-elements formed with a spherical outer surface, has one toy-element of a preferential design in which the corner directed to the center of the large cube is formed in such a manner, that the spatial axes starting from the corners and forming the inner intersecting axes of the large cube should simultaneously cross the center of the faces of the large cube.

The remaining seven cubes are identically shaped and the corners thereof, directed to the geometrical center of the large cube, are formed as profiled solids. The seven cubes are fixed by means of 2 threaded pivots each enclosed by a spring and passing through connecting elements arranged between the cubes to that part of the eighth small cube of preferential position and design, which is directed to the center of the large cube and which is shaped as a cubiform profiled solid. In such a manner, by the aid of the resilient connecting elements arranged in between, the small cubes can be rotated in any optional direction along the spatial axes crossing the centers of the lateral surfaces of the large cube.

BRIEF DESCRIPTION OF THE DRAWINGS

The invention will be described in more detail by means of preferred embodiments and by the aid of the accompanying drawing, wherein.

DETAILED DESCRIPTION OF THE PREFERRED EMBODIMENTS

Figure 1A:
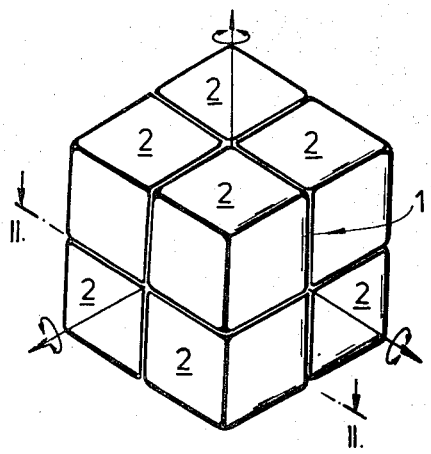
FIGS. 1*a* and 1*b* are plan views of the spatial logical toy according to the invention assembled as a cube and a sphere respectively.
Figure 1B:
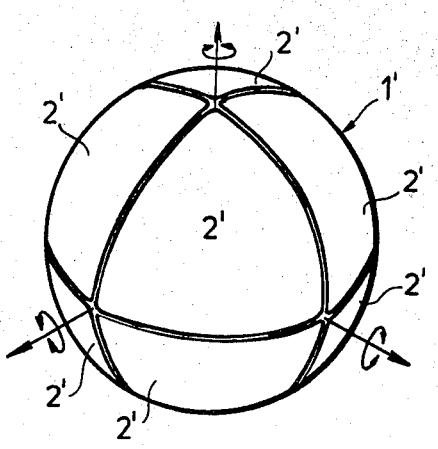
Figure 2:
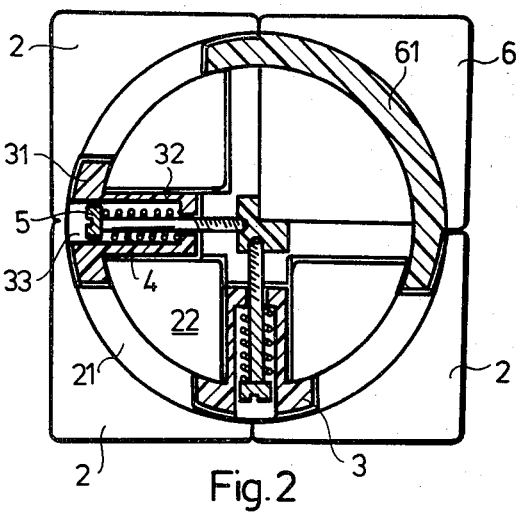
FIG. 2 is a sectional view of the cubiform logical toy along line II—II of FIG. 1*a*.
Figure 3:
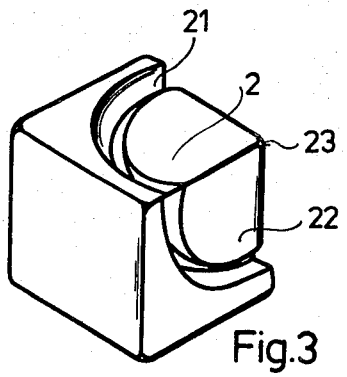
FIG. 3 is a plan view of one of the seven identically shaped toy-elements.
Figure 4:
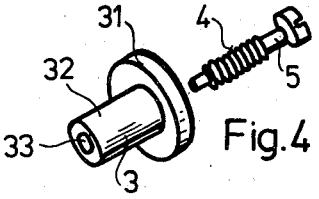
FIG. 4 is an exploded view of the elastic pivot.
Figure 5:
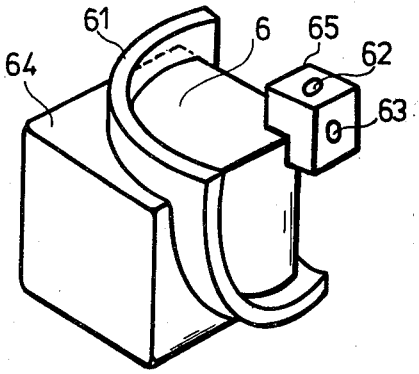

Referring to FIGS. 1*a* and 1*b*, the spatial logical toy according to the invention consists of the large cube 1 or sphere 1', containing seven identical toy-elements, small cubes 2 or spherical segments 2' and an eighth toy-element which has a similarly shaped outward appearance as the other toy-elements but which has a design differing from that of the other seven elements. The eighth elements 6,6' are hidden from view in FIGS. 1*a* and 1*b*. Referring now to FIGS. 2–5, the corners 23 of the seven small cubes 2 which are directed to the geometrical center of the large cube 1 are shaped as a reduced size cubic segment 22 confined with spherical grooves 21, which when fitted to each other, enclose spaces with an approximately T-shaped section as shown in FIG. 2. Connecting profiles 3 each having a mushroom-shaped head 31 and a cylindrical body 32 with throughbore 33 are fitted into said spaces. A threaded screw 5 having the shaft thereof surrounded by spring 4 is passed through the throughbore 33, and the threaded end of screw 5 is screwed into the internally threaded holes 62, 63 formed in an extension 65 of cube 64 which are parts of the eighth small cube 6 as shown in FIGS. 2 and 5. The holes 62, 63 are directed to the geometric center of the large cube. The small cube 6 comprises the cubic member 64 with a spherical cam 61 extending on three surfaces thereof and having as its spherical center, the geometrical center of the "large cube".

Accordingly, the corner of the eighth toy-element 6 of the regular solid assembled in accordance with the invention, which is illustrated as a cube, as in the case of spherical grooves 21 of the seven identically shaped toy-elements 2, is directed to the geometrical center of the solid forming the toy, and is formed in such a manner, that the spatial axes crossing the centers of the surfaces of the large cube are also connected to said corners. Rotation is ensured by the resilient mounted pivot screws 5 and the spherical surfaces to be slidingly rotated on each other. The spherical surfaces are the elements of a spherical surface, the center of which is common with the center of the "large cube".

In such a manner the connection between the intersecting axes lying in the geometrical center of the logical toy according to the invention and the eight toy-elements forming the toy-surface ensures, in whatever direction rotation is taking place, the proper position of the spatial axes in relation to the surface of the "large cube", i.e. the possibility of the free choice of turning.

By choosing the spherical surfaces 61 for the matching grooves 21 of the toy-elements 2, it becomes possible to leave out entirely the twelve connecting elements having been described in connection with the device according to HU-PS No. 170 062 and to simplify considerably the constructional principle of the original logical toy, while simultaneously obtaining the utmost diversified combinational possibilities for the turning of the cubes in optional directions.

Figure 6:
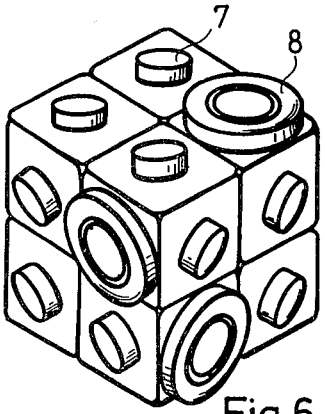
FIG. 5 is a plan view of the eighth toy-element and FIG. 6 is a plan view of a preferred embodiment of the spatial logical toy with the pivots on the surfaces of the large cube and rings to be fitted onto the pivots.

As shown in FIG. 6, one of the possible combinations of the spatial logical toy is realized in such a manner that on each outer surface of the toy-elements 2 and 6, a cylindrical pivot 7 is formed, onto a set of which a ring 8 is releasably mounted. By this embodiment, the forfeit-game character of the spatial logical toy may be emphasized, since by rotating the single fields several possibilities of variations are obtained.

What is claimed is:

1. In a spatial logical toy having the form of a regular geometric solid and wherein halves thereof are relatively rotatable about midpoints of three orthogonal axes, the improvement wherein the toy is assembled from eight toy elements comprising seven identical toy elements each having exterior surfaces for forming the regular geometric solid shape and interior orthogonal plenar surfaces the corners of which are directed to the geometrical center of the solid when assembled, the interior surfaces each being recessed at the corner and confined by a spherical groove and an eighth toy element having exterior surfaces completing the solid shape with the seven toy elements and having interior orthogonal planar surfaces forming a corner at the geometric center of the toy, the interior surfaces of the eighth toy element having a spherical cam cooperative with the spherical grooves of the seven toy elements and means forming two interior threaded bores directed to the geometric center of the toy, and toy element connecting means comprising two connecting elements each having a substantially T-shaped cross section, the head portions of which are configured to be received in the spherical grooves with the body portions disposed between the recessed portions of the interior surfaces of the seven toy elements and including a throughbore, two screw elements inserted in the throughbores and threadably engaged with the two interior threaded bores and two spring elements bringing the connecting elements towards the geometric center of the toy.

2. The toy according to claim 1, wherein the solid is a cube and the eight toy elements are substantially cubic in shape.

3. The toy according to claim 1, wherein the solid is a sphere.

4. The toy according to claim 2, wherein the exterior surfaces have pivots thereon and the toy further comprises rings which are releasably mountable on the pivots.

* * * * *